US009642402B1

(12) United States Patent
Scherr et al.

(10) Patent No.: US 9,642,402 B1
(45) Date of Patent: May 9, 2017

(54) PROTECTING AN ATHLETIC PARTICIPANT AGAINST IMPACT INJURY

(71) Applicant: Ass Armor , LLC, Boca Raton, FL (US)

(72) Inventors: Casey Scherr, Boca Raton, FL (US); Ira Rothbaum, Closter, NJ (US); Erika J. Olshin, New York, NY (US); Matthew Edwards, Tonbridge (GB)

(73) Assignee: Ass Armor, LLC, Boca Raton, FL (US)

( * ) Notice: Subject to any disclaimer, the term of this patent is extended or adjusted under 35 U.S.C. 154(b) by 0 days.

(21) Appl. No.: 14/600,355

(22) Filed: Jan. 20, 2015

Related U.S. Application Data

(60) Provisional application No. 61/929,540, filed on Jan. 21, 2014.

(51) Int. Cl.
*A41D 13/015* (2006.01)
*A41D 13/05* (2006.01)
*A41D 1/08* (2006.01)

(52) U.S. Cl.
CPC ..... *A41D 13/0537* (2013.01); *A41D 13/015* (2013.01); *A41D 1/08* (2013.01); *A41D 1/082* (2013.01)

(58) Field of Classification Search
CPC ..... A41D 13/0537; A41D 13/015; A41D 13/0506; A41D 13/0525; A41D 1/08; A41D 1/082; A41D 1/084; A41D 1/086; A41D 1/088; A41D 1/067; A41D 13/0512; A41D 13/0531; A41D 13/0543; A41D 13/065; A41D 13/06; A41D 13/08; A41D 31/005; A41D 2600/104; A61F 5/0104; A61F 5/02; A61F 5/022; A61F 5/028
USPC ..... 2/465, 467, 267, 464, 466, 24, 44; 602/6, 19
See application file for complete search history.

(56) References Cited

U.S. PATENT DOCUMENTS 3,909,847 A * 10/1975 Holt ..... A41D 1/088 128/846
5,365,610 A * 11/1994 Lubahn ..... A41D 13/015 2/227
5,551,082 A * 9/1996 Stewart ..... A41D 1/08 2/227
5,619,747 A * 4/1997 Boisclair ..... A41D 13/015 2/44
5,636,377 A * 6/1997 Wiener ..... A41D 13/015 2/2.5
5,983,407 A * 11/1999 McKay ..... A41D 13/0531 2/231

(Continued)

*Primary Examiner* — Amy Vanatta
(74) *Attorney, Agent, or Firm* — Fish & Richardson P.C.

(57) ABSTRACT

An article, garment and method protect a participant in an athletic activity against injury to the coccyx as well as to the buttocks of the participant. A core member of the article is constructed of an elastic composite that establishes a resistive load under deformation, in a lobed protective contour configuration, and an outer shell is integrated with the core member to provide a degree of stiffness for biasing the elastic composite of the core member toward the protective contour configuration during conduct of the athletic activity, while enabling flexing of the article to accommodate the athletic activity, such that upon fitting the article over the coccyx of the participant, as well as in juxtaposition with the participant's buttocks, the core member will protect against an impact, while the outer shell resists damage to the core member.

12 Claims, 3 Drawing Sheets

(56) References Cited

U.S. PATENT DOCUMENTS 6,009,565 A * 1/2000 Carrington ..... A41D 13/015 2/227
6,317,888 B1 * 11/2001 McFarlane ..... A41D 13/0568 2/24
6,327,715 B1 * 12/2001 Castiglione ..... A41D 1/082 2/227
6,961,958 B1 * 11/2005 Seitzinger ..... A41D 13/0525 2/2.5
7,891,026 B1 * 2/2011 Smith ..... A41D 13/0506 2/465
8,272,073 B2 * 9/2012 Arensdorf ..... A41D 1/08 2/228
8,719,965 B2 * 5/2014 Turner ..... A41D 13/0506 2/228
2003/0167557 A1 * 9/2003 LaShoto ..... A41D 13/015 2/228
2006/0059609 A1 * 3/2006 Moss ..... A41D 13/0506 2/455
2008/0229486 A1 * 9/2008 Maier ..... A41D 1/084 2/401
2009/0165193 A1 * 7/2009 Michel ..... A41D 13/0153 2/459
2011/0277226 A1 * 11/2011 Turner ..... A41D 13/05 2/461
2012/0216327 A1 * 8/2012 Turner ..... A41D 13/0156 2/69
2012/0222191 A1 * 9/2012 Maier ..... A41D 1/084 2/79
2013/0000025 A1 * 1/2013 Garneau ..... A41D 1/084 2/466
2014/0208492 A1 * 7/2014 Foley ..... A41D 13/05 2/459
2015/0196070 A1 * 7/2015 Burger ..... A41D 1/08 2/465
2015/0290017 A1 * 10/2015 Taylor ..... A61F 5/02 602/7
2016/0192714 A1 * 7/2016 Williams ..... A41B 9/12 2/455

* cited by examiner

PROTECTING AN ATHLETIC PARTICIPANT AGAINST IMPACT INJURY

This application claims benefit under 35 U.S.C. §119(e) to U.S. Provisional Patent Application 61/929,540, filed Jan. 21, 2014.

The present invention relates generally to the protection of certain areas of the human body against injury caused by an impact experienced during an athletic endeavor and pertains, more specifically, to articles and a method for protecting one or more of the coccyx and the buttocks against injury resulting from an impact, and especially an impact occasioned by a fall during an athletic pursuit.

The abundance of facilities being made available for snow sports and, more particularly, snowboarding, together with the less-than-prohibitive cost of snow sport equipment, has led to an ever-increasing number of participants in these sports. Unfortunately, the increasing number of participants has been accompanied by more incidents of injury, especially among novices who experience frequent falls, resulting in painful injuries due to impacts on either or both the coccyx and the buttocks of the participant. Moreover, professional athletes engaged in snow sports, and especially snowboarding, are exposed to even greater risk of severe injury.

The present invention addresses the need for providing practical and effective protection against the injuries outlined above. As such, the present invention attains several objects and advantages, some of which are summarized as follows: Provides a relatively simple, yet highly effective construction and method for protecting against injury to one or both the coccyx and the buttocks of a participant in an athletic activity and, in particular, a person engaged in snowboarding, skiing, ice skating or the like; adapts proven impact protection technology to an effective, practical article easily worn during the practice of snow sports, and especially snowboarding and the like; enables the use, especially by participants in snowboarding and the like, including both professionals and novices, of an unobtrusive, comfortable garment that provides effective protection against injury to the coccyx or the buttocks occasioned by an impact, particularly that experienced upon falling on the corresponding area of the participant's body; promotes greater safety during athletic pursuits, and especially in the practice of snowboarding and the like; enables economical manufacture and distribution of a highly effective protective article for widespread practical use by a variety of participants, both professional and novice, in snowboarding, as well as other snow sports, such as skiing, ice skating and similar activities; provides an aesthetically pleasing protective measure, encouraging ready adoption and use; encourages participation in snow sports, and especially in snowboarding, by reducing the fear of injury and concomitant pain, and thereby increasing confidence and promoting the development of skill for enhanced enjoyment of the sport; provides a rugged, yet comfortable protective garment capable of serving to protect against injury over a long-term effective service life.

The above objects and advantages, as well as further objects and advantages, are attained by the present invention which may be described briefly as an article constructed for protecting a participant in an athletic activity against injury to at least the coccyx of the participant, the article comprising: a core member constructed of an elastic composite that establishes a resistive load under deformation, the core member having a protective contour configuration including an arched central portion having a upper lobe and a lower lobe extending longitudinally along a curved path, the core member further having an outer face, an inner face and a predetermined altitudinal thickness between the outer face and the inner face; and an outer shell integrated with the outer face of the core member, the outer shell having a contour configuration complementary to the protective contour configuration of the core member, and an altitudinal thickness less than the predetermined altitudinal thickness of the core member, the outer shell being constructed with a degree of stiffness for biasing the elastic composite of the core member toward the protective contour configuration of the core member during conduct of the athletic activity, while enabling flexing of the article to accommodate the athletic activity, such that upon fitting the article over the coccyx of the participant, the core member will protect against an impact, while the outer shell will resist damage to the core member.

In addition, the present invention provides a protective garment constructed for protecting a participant in an athletic activity against injury to at least the coccyx of the participant, the protective garment including a rear crotch for location in juxtaposition with the coccyx and the buttocks of the participant, the protective garment comprising the article set forth above, integrated into the protective garment, placed adjacent the rear crotch of the garment.

Further, the present invention includes a method for protecting a participant in an athletic activity against injury to at least the coccyx of the participant, the method comprising fitting the article described above to the participant for placement over at least the coccyx of the participant during conduct of the athletic activity.

The invention will be understood more fully, while still further objects and advantages will become apparent, in the following detailed description of preferred embodiments of the invention illustrated in the accompanying drawing, in which.

Figure 1:
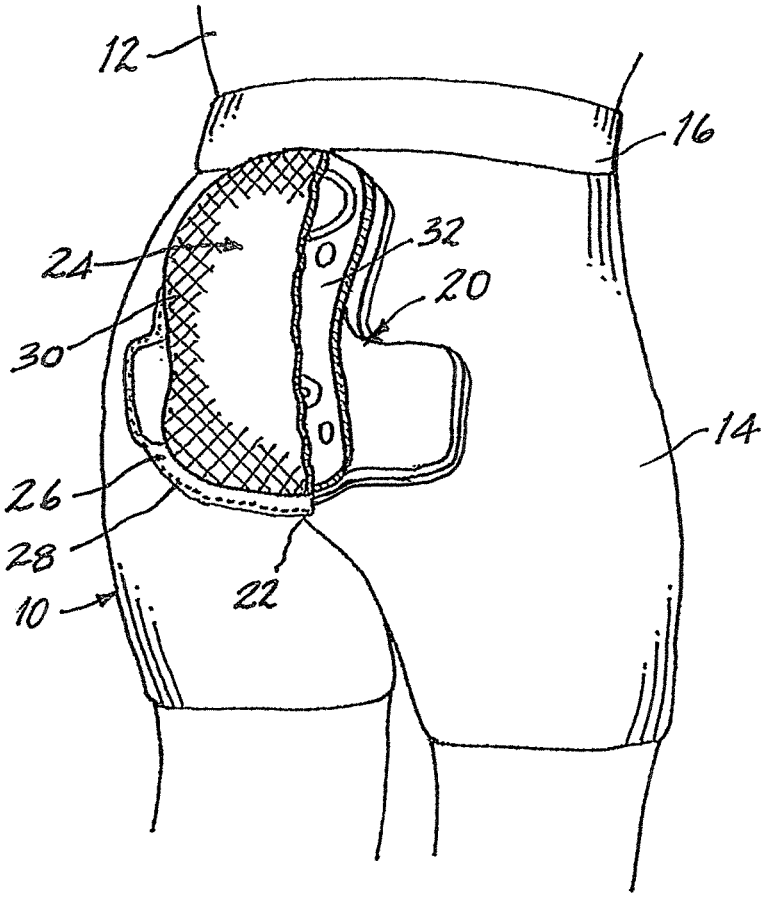
FIG. 1 is a pictorial depiction, partially broken away, showing a garment constructed in accordance with the present invention, as worn by a subject being protected.
Figure 2:
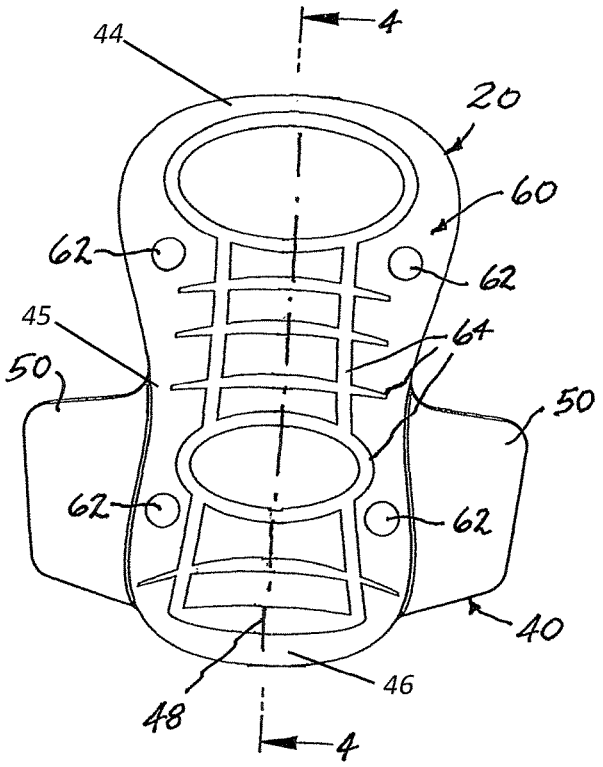
FIG. 2 is a plan view of the protection system of the garment, detached from the garment to reveal details of construction.

Referring now to the drawing, and especially to FIG. 1 thereof, a protective garment constructed in accordance with the present invention is shown in the form of a unisex short 10 and is seen to be worn in place upon a person 12 intending to participate in a snow sport, such as snowboarding. Short 10 preferably is constructed of a dry-fit stretch knit fabric 14 for comfort, ease of use and aesthetic appeal. Minimal seaming is employed so as to avoid any extra tightness or chafing, and an elastic waistband 16 is provided for snug comfort. The stretch knit fabric 14 wicks away moisture and maintains a breathable feeling under layers of gear normally worn during snow sports.

A protection system 20 is integrated into short 10 and is seen placed adjacent the rear crotch 22 of the short 10 so as to be located in juxtaposition with the coccyx, also known as the tailbone, and the buttocks of the person 12. A fabric cover 24 overlies protection system 20 and is joined to short 10 along a border 26, as by stitching 28 or the like, to secure protection system 20 in place. In the preferred construction, a mesh panel 30 is incorporated into cover 24 and extends over at least a central area 32 of protection system 20, for aesthetic as well as functional purposes.

Turning now to FIGS. 2 through 5, as well as to FIG. 1, protection system 20 is comprised of a core member 40 constructed of a soft and flexible shock-absorbing material. In the preferred construction, core member 40 is a composite material made available by Design Blue Limited, under the registered trademark D30®. The material is an elastic composite that blends polymers and dilatant fluid to exhibit a resistive load under deformation which increases with a rate of deformation, thereby serving to protect against impact, all as more fully described in U.S. Pat. Nos. 7,381,460, 7,794,827, 8,387,170, and 8,856,971, the disclosures of which are incorporated herein by reference thereto.

Figure 4:
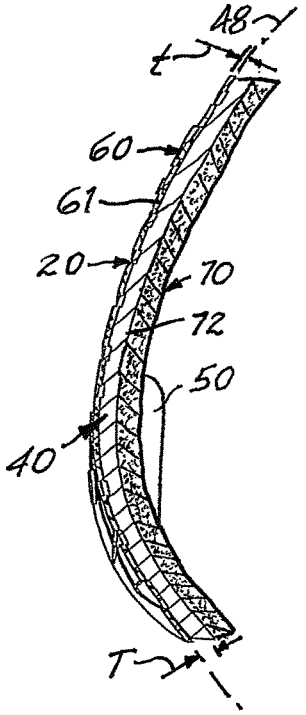
FIG. 4 is a cross-sectional view taken along line 4-4 of FIG. 3.
Figure 3:
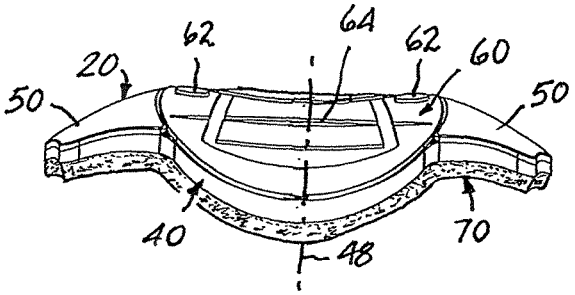
FIG. 3 is an end view of the protection system of FIG. 2.
Figure 5:
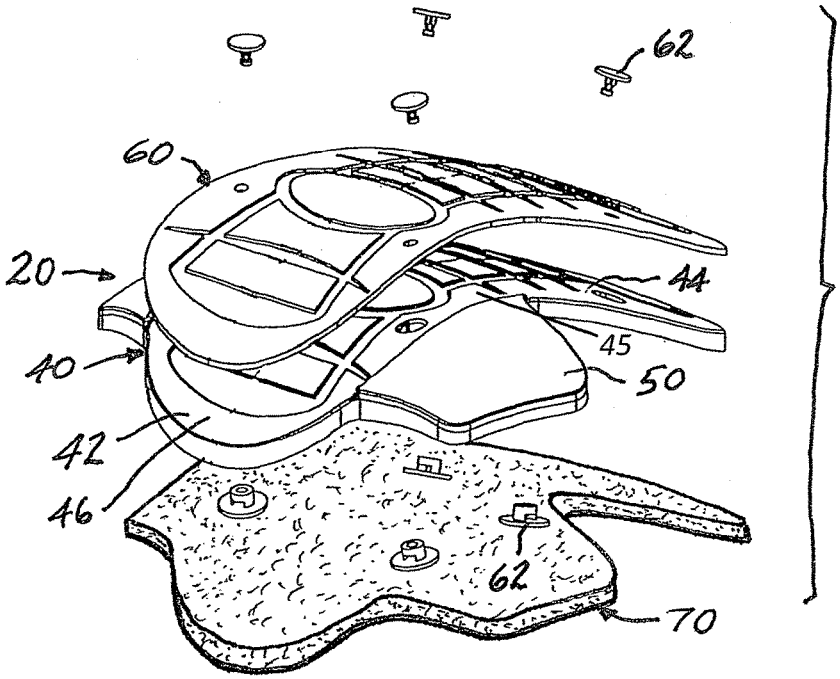
FIG. 5 is an exploded perspective view of the protection system.

Core member 40 is molded, or otherwise formed, into a contour configuration corresponding to the contour configuration encountered at the rear crotch 22 of short 10 when short 10 is worn by person 12 and includes an arched central portion 42 having a lobed configuration that includes an upper lobe 44 and a lower lobe 46, with both lobes 44 and 46 extending longitudinally along a curved path 48. The upper lobe 44 is joined to the lower lobe 46 at a waist 45 with a maximum width of the upper lobe 44 being larger than a maximum width of the lower lobe 46 and the maximum width of the lower lobe 46 being larger than a width of the waist 45. A pair of winged portions 50 extend laterally in opposite corresponding directions 10 from adjacent lower lobe 46 and follow the contour configuration of core member 40. Once short 10 is in place upon a person 12, as illustrated in FIG. 1, the lobed configuration of central portion 42 assures that central portion 42 is located and secured in place in juxtaposition with the person's coccyx during the activity being conducted by the person 12, while the winged portions 50 lend stability so as to maintain the core member 40, and the central portion 42 thereof, accurately in place. At the same time, the winged portions 50 are located in juxtaposition with the person's buttocks. As best seen in FIG. 4, in the preferred construction, core member 40 has an altitudinal thickness T of about six millimeters.

A relatively stiff, yet flexible outer shell 60 is joined with outer face 61 of core member 40, as by rivets 62 to integrate outer shell 60 with core member 40. Outer shell 60 preferably is constructed of a synthetic polymeric material, such as a polypropylene, and is thinner than core member 40 so as to minimize bulk, outer shell 60 preferably having a thickness t of about one and one-half to two millimeters. Outer shell 60 serves to bias the elastic composite of core member 40 resiliently toward the overall contour configuration of central portion 42, while shielding against piercing or otherwise damaging the underlying material of core member 40. A pattern of reinforcing channels 64 in outer shell 60 assists in maintaining the desired contour configuration of central portion 42, without adding significantly to the overall thickness of protection system 20.

A layer 70 of a soft, resilient foam material is integrated with inner face 72 of core member 40, as seen in FIG. 4, preferably by means of an adhesive, and is made about the same thickness as core member 40, to be interposed between the core member 40 and person 12. Layer 70 extends along the central portion 42 of core member 40, as well as along the winged portions 50 for providing enhanced comfort, without adding significantly to the bulk of protection system 20.

It will be seen that the present invention attains all of the objects and advantages summarized above; namely, Provides a relatively simple, yet highly effective construction and method for protecting against injury to one or both the coccyx and the buttocks of a participant in an athletic activity and, in particular, a person engaged in snowboarding, skiing, ice skating or the like; adapts proven impact protection technology to an effective, practical article easily worn during the practice of snow sports, and especially snowboarding and the like; enables the use, especially by participants in snowboarding and the like, including both professionals and novices, of an unobtrusive, comfortable garment that provides effective protection against injury to the coccyx or the buttocks occasioned by an impact, particularly that experienced upon falling on the corresponding area of the participants body; promotes greater safety during athletic pursuits, and especially in the practice of snowboarding and the like; enables economical manufacture and distribution of a highly effective protective article for widespread practical use by a variety of participants, both professional and novice, in snowboarding, as well as other snow sports, such as skiing, ice skating and similar activities; provides an aesthetically pleasing protective measure, encouraging ready adoption and use; encourages participation in snow sports, and especially in snowboarding, by reducing the fear of injury and concomitant pain, and thereby increasing confidence and promoting the development of skill for enhanced enjoyment of the sport; provides a rugged, yet comfortable protective garment capable of serving to protect against injury over a long-term effective service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An article constructed for protecting a participant in an athletic activity against injury to at least the coccyx of the participant, the article comprising:

a core member constructed of an elastic composite that establishes a resistive load under deformation, the core member having a protective contour configuration including a central portion having an upper lobe and a lower lobe extending longitudinally along a curved path, the core member further having an outer face, an inner face and a predetermined thickness between the outer face and the inner face; and an outer shell integrated with the outer face of the core member, the outer shell having a contour configuration complementary to the protective contour configuration of the core member, and a thickness less than the predetermined thickness of the core member, wherein the core member and the outer shell have an arched configuration at rest from which the core member and the outer shell can flex during athletic activity, the outer shell being constructed with a degree of stiffness for biasing the elastic composite of the core member toward the protective contour configuration of the core member during conduct of the athletic activity, while enabling flexing of the article to accommodate the athletic activity, such that upon fitting the article over the coccyx of the participant, the core member will protect against an impact, while the outer shell will resist damage to the core member; and wherein the core member includes a pair of winged portions extending laterally in opposite corresponding directions from the lower lobe, each winged portion continuing the protective contour configuration for stabilizing the location of the central portion in juxtaposition with the coccyx of the participant, while extending the core member into juxtaposition with the buttocks of the participant during conduct of the athletic activity.

2. The article of claim 1 including an inner layer of resilient material integrated with the inner face of the core member, along the central portion of the core member, the inner layer providing a comfortable and effective fit over the coccyx of the participant.

3. The article of claim 2 wherein the outer shell includes a pattern of channels configured for reinforcing the stiffness of the outer shell.

4. The article of claim 1 wherein the outer shell includes a pattern of channels configured for reinforcing the stiffness of the outer shell.

5. The article of claim 1 wherein the upper lobe is joined to the lower lobe at a waist with a maximum width of the upper lobe being larger than a maximum width of the lower lobe and the maximum width of the lower lobe being larger than a width of the waist.

6. A protective garment constructed for protecting a participant in an athletic activity against injury to at least the coccyx of the participant, the protective garment including a rear crotch for location in juxtaposition with the coccyx and the buttocks of the participant, the protective garment comprising the article of claim 1 integrated into the protective garment, placed adjacent the rear crotch of the garment.

7. The protective garment of claim 6 including an inner layer of resilient material integrated with the inner face of the core member, along the central portion of the core member, the inner layer providing a comfortable and effective fit over the coccyx of the participant.

8. The protective garment of claim 7 wherein the outer shell includes a pattern of channels configured for reinforcing the stiffness of the outer shell.

9. The protective garment of claim 6 wherein the outer shell includes a pattern of channels configured for reinforcing the stiffness of the outer shell.

10. The protective garment of claim 6 including a cover overlying the article, the cover being joined to the protective garment to secure the article in place adjacent the rear crotch.

11. A method for protecting a participant in an athletic activity against injury to at least the coccyx of the participant, the method comprising fitting the article of claim 1 to the participant for placement over at least the coccyx of the participant during conduct of the athletic activity.

12. The method of claim 11 including providing the article with an inner layer of resilient material integrated with the inner face of the core member, along the central portion of the core member, the inner layer providing a comfortable and effective fit over the coccyx of the participant.

* * * * *